US011773839B2

(12) United States Patent
Van Stell

(10) Patent No.: US 11,773,839 B2
(45) Date of Patent: Oct. 3, 2023

(54) MULTI-ROLLER PERISTALTIC PUMP HEAD

(71) Applicant: Masterflex, LLC, Radnor, PA (US)

(72) Inventor: James Van Stell, Schaumburg, IL (US)

(73) Assignee: Masterflex, LLC, Radnor, PA (US)

( * ) Notice: Subject to any disclaimer, the term of this patent is extended or adjusted under 35 U.S.C. 154(b) by 224 days.

(21) Appl. No.: 17/178,626

(22) Filed: Feb. 18, 2021

(65) Prior Publication Data

US 2022/0260069 A1 Aug. 18, 2022

Related U.S. Application Data

(60) Provisional application No. 62/983,982, filed on Mar. 2, 2020.

(51) Int. Cl.
*F04B 43/12* (2006.01)
*F04B 43/00* (2006.01)

(52) U.S. Cl.
CPC ..... *F04B 43/1238* (2013.01); *F04B 43/0009* (2013.01); *F04B 43/1284* (2013.01)

(58) Field of Classification Search
CPC ..... F04B 53/16; F04B 53/22; F04B 43/08–43/1136; F04B 43/12; Y10T 292/0911; Y10T 292/0921; Y10T 292/1039; Y10T 292/1043; Y10T 403/595; Y10T 403/7007; Y10T 403/7071; Y10S 292/11; F16B 21/02; F16B 2/18; F16B 21/04; F16B 7/20; F16B 5/10; F16B 2/185
USPC ..... 417/360, 477.3; 403/187, 321
See application file for complete search history.

(56) References Cited

U.S. PATENT DOCUMENTS 2,956,734 A * 10/1960 Doyle ..... A47L 5/365 415/214.1
5,021,048 A * 6/1991 Buckholtz ..... F04D 29/628 417/420
5,316,347 A * 5/1994 Arosio ..... F16L 37/56 285/85
7,722,338 B2 * 5/2010 Nordell ..... F04B 43/1253 417/477.2
8,545,196 B2 * 10/2013 Krause ..... F04B 43/1253 417/477.1

(Continued)

FOREIGN PATENT DOCUMENTS

EP 2138511 A * 10/1984 ..... F04B 43/1284

*Primary Examiner* — Philip E Stimpert
*Assistant Examiner* — Dnyanesh G Kasture
(74) *Attorney, Agent, or Firm* — Faegre Drinker Biddle & Reath LLP

(57) ABSTRACT

A peristaltic pump may include a rotor rotatably mounted between a base of the peristaltic pump head and an end cap of the peristaltic pump head. The peristaltic pump may include an arcuate case between the base and the end cap partially surrounding the rotor. The peristaltic pump may include an arcuate occlusion bed removably mounted between the base and the end cap. The arcuate case and the arcuate occlusion bed form a cylindrical body around the rotor. The peristaltic pump may include a locking handle hingedly mounted to the arcuate occlusion bed, wherein the locking handle includes a bar extending between a pair of cam members, each cam member including a cam slot that engages a respective pin extending from the base and the end cap.

5 Claims, 10 Drawing Sheets

(56) References Cited

U.S. PATENT DOCUMENTS

| | | | | |
|---|---|---|---|---|
| 8,985,969 | B2 * | 3/2015 | Hoshi | F04D 13/02 417/423.15 |
| 11,041,584 | B2 * | 6/2021 | Foner | F16L 37/16 |
| 2004/0138617 | A1 * | 7/2004 | Oyaski | A61M 5/14212 604/131 |
| 2014/0086771 | A1 * | 3/2014 | Bassani | F04B 43/12 417/474 |
| 2016/0010635 | A1 * | 1/2016 | Chan | F04B 43/1261 417/477.1 |
| 2018/0023555 | A1 * | 1/2018 | Petrofsky | F04B 43/1253 417/53 |

* cited by examiner

MULTI-ROLLER PERISTALTIC PUMP HEAD

CROSS REFERENCE TO RELATED APPLICATIONS

This application claims priority to U.S. Provisional Application No. 62/983,982 titled "MULTI-ROLLER PERISTALTIC PUMP HEAD," filed Mar. 2, 2020, which is assigned to the assignee hereof, and incorporated herein by reference in its entirety.

INTRODUCTION

The present disclosure generally relates to peristaltic pumps.

BACKGROUND

Rotary peristaltic pumps are typically used for moving liquids through flexible tubing. A typical peristaltic pump has a rotor assembly with pinch rollers that apply pressure to the flexible tubing at spaced locations to provide a squeezing action on the tubing against an occlusion bed. The occlusion of the tubing creates increased pressure ahead of the squeezed area and reduced pressure behind that area, thereby forcing a liquid through the tubing as the rotor assembly moves the pinch rollers along the tubing.

The spacing between the occlusion bed and the pinch rollers of the rotor assembly is critical for proper pump operation. The spacing between the occlusion bed and the pinch rollers is unforgiving from a tolerance standpoint since it is used both to provide a compressive force between the rotor assembly and occlusion bed and to locate the occlusion bed with respect to the rotor assembly. Tubing that is too loose in the pump may lead to flapping while tubing that is too tight may lead to excessive wear on the tubing. Improper installation of the tube may lead to poor pump performance and shortened tube life.

Various mechanisms exist in the related art for moving the occlusion bed with respect to the rotor assembly. Such mechanisms, however, often allow movement of the occlusion bed, especially when high pressures and cyclic loading are applied as the rotor assembly rotates. Further, a multi-roller peristaltic pump may utilize multiple tubes that are compressed by multiple rollers at different times. Such multi-roller peristaltic pumps face additional issues with applying even pressure to the multiple tubes.

Accordingly, there is a need for a durable peristaltic pump including an occlusion bed that accommodates multiple tubes, resists movement, and is durable for an operating life of the peristaltic pump.

SUMMARY

The following presents a simplified summary of one or more aspects of the invention in order to provide a basic understanding of such aspects. This summary is not an extensive overview of all contemplated aspects, and is intended to neither identify key or critical elements of all aspects nor delineate the scope of any or all aspects. Its purpose is to present some concepts of one or more aspects in a simplified form as a prelude to the more detailed description that is presented later.

In one aspect, the disclosure provides a peristaltic pump head. The peristaltic pump head may include a rotor rotatably mounted between a base of the peristaltic pump head and an end cap of the peristaltic pump head. The peristaltic pump head may include an arcuate case between the base and the end cap partially surrounding the rotor. The peristaltic pump head may include an arcuate occlusion bed removably mounted between the base and the end cap, wherein the arcuate case and the arcuate occlusion bed form a cylindrical body around the rotor. The peristaltic pump head may include a locking handle hingedly mounted to the arcuate occlusion bed. The locking handle may include a bar extending between a pair of cam members, each cam member including a cam slot that engages a respective pin extending from the base and the end cap.

In another aspect, a peristaltic pump head includes a rotor rotatably mounted between a base of the peristaltic pump head and an end cap of the peristaltic pump head. The rotor may include a base plate; an end plate; a central shaft extending through the base plate and the end plate; a central gear driven by the central shaft; and a plurality of planetary shafts mounted between the base plate and the end plate around the central shaft. Each planetary shaft may be connected to a planetary gear in meshed engagement with the central gear. The peristaltic pump head may include a pair of composite bushings in each of the base and the end cap rotatably retaining the central shaft. The peristaltic pump head ma include a pair of composite bushings in the base plate and the end plate retaining each of the plurality of planetary shafts.

In another aspect, the disclosure provides a peristaltic pump. The peristaltic pump may include a mounting plate attached to an external surface of a housing. The mounting plate may have an internal wall defining an opening into the housing for receiving a central rotor shaft of a pump head. The peristaltic pump may include an annular collar extending from an external surface of the mounting plate and surrounding the opening, the annual collar including a pair of L-shaped slots opening at an exterior surface of the annular collar. The peristaltic pump may include a lock lever pivotably mounted to the mounting plate and movable between a locked position with an end of the lock lever within one of the L-shaped slots and an unlocked position with the end of the lock lever outside of the L-shaped slot.

These and other aspects of the invention will become more fully understood upon a review of the detailed description, which follows.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are shown in block diagram form in order to avoid obscuring such concepts.

In an aspect, the disclosure provides for a multi-roller peristaltic pump head that utilizes an arcuate occlusion bed with a cam locking handle. The cam locking handle allows over the center pressure to lock the arcuate occlusion bed to a pump head case. The cam locking handle includes a cam member at each end with positive lock into detent for a locking pin at the end of a cam slot. The locking handle stays locked under high occlusion forces. The two cam members secure the occlusion bed due to locking points on each side of the occlusion bed.

In another aspect, the multi-roller peristaltic pump head includes a rotor having a central shaft and a plurality of planetary shafts around the central shaft. The multi-roller peristaltic pump head receives two or more tubes. A central gear driven by the central shaft drives planetary gears connected to each of the planetary shafts. A roller is mounted on each planetary shaft and the planetary shaft rotates the roller over one of the tubes. The central shaft is retained in a pair of composite bushings between a pump head base and a pump head end cap. Each of the orbital shafts is retained in a pair of composite bushings in a rotor base plate and a rotor end plate.

In another aspect, the peristaltic pump includes a quick connect feature for mounting the peristaltic pump head on a pump housing. The pump housing may include a motor and control circuitry for driving the motor and the peristaltic pump head. The quick connect feature may include a mounting plate attached to an external surface of the pump housing. The mounting plate may include an annular collar extending from the mounting plate. The annular collar may include opposing L-shaped slots. The pump head may include a mounting hub having opposing radially extending posts. The posts may be located in the L-shaped slots, and the mounting hub may be turned to engage the pump head to the pump housing. The quick connect feature may include a locking lever pivotably mounted to the mounting plate and movable between a locked position with an end of the lock lever within one of the L-shaped slots and an unlocked position with the end of the lock lever outside of the L-shaped slot.

Figure 1:
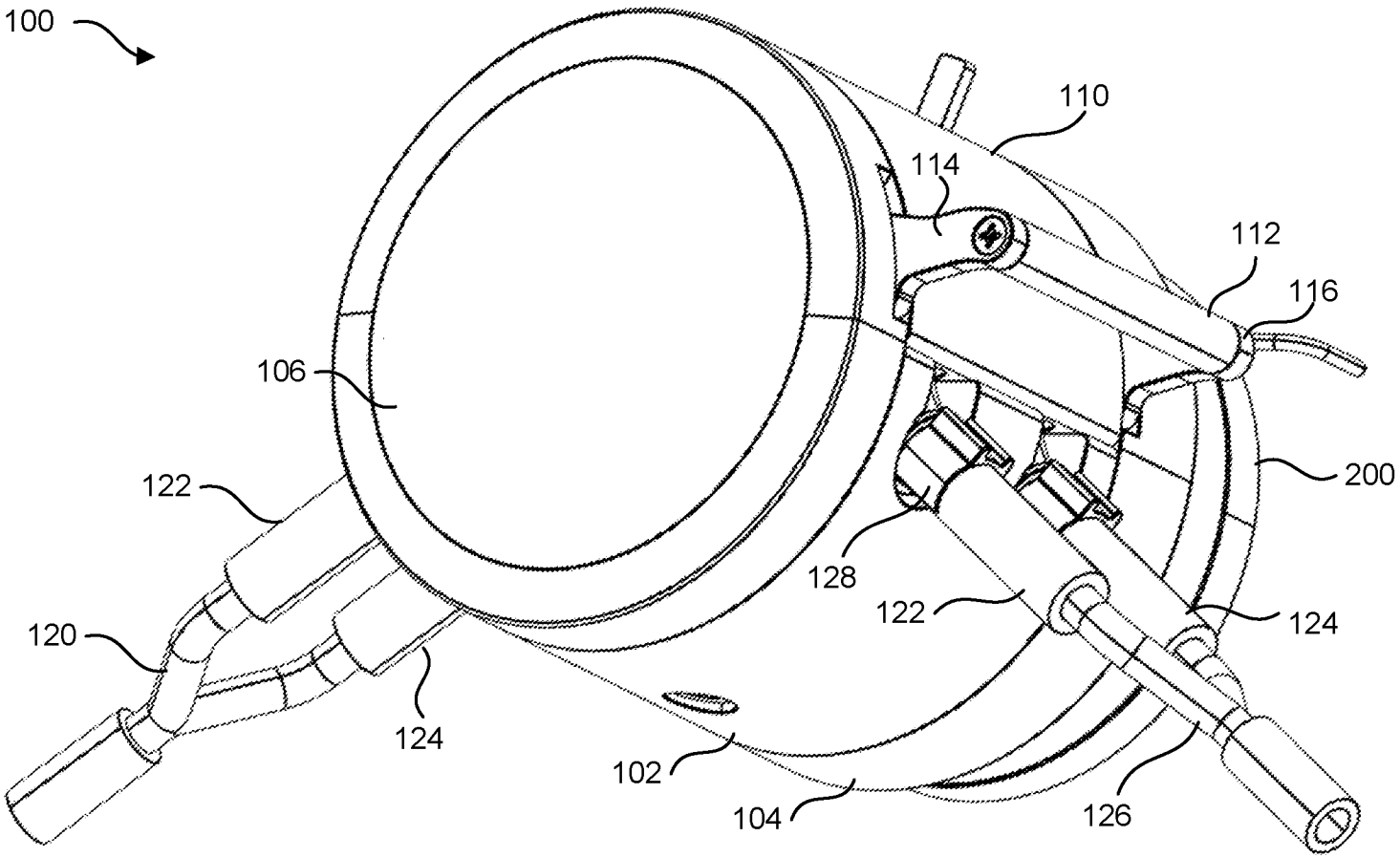
FIG. 1 is perspective view of an example peristaltic pump head including an arcuate occlusion bed, according to an aspect of the disclosure.

FIG. 1 is perspective view of an example peristaltic pump head 100 including an arcuate occlusion bed 110. The pump head 100 may include an arcuate case 102 that partially surrounds a rotor. The pump head 100 may include a base 104 at an end proximate a connector 200, which may be attached to an external surface of a pump housing. The arcuate occlusion bed 110 and the arcuate case 102 may form a cylindrical body of the pump head 100. The pump head 100 may include an end cap 106 at an end distal from the connector 200.

In an aspect, the pump head 100 may pump fluid from a single source to a single destination via two or more tubes 122, 124. The tubes 122, 124 may be connected via a source Y-connector 120 and an outlet Y-connector 126. Using two or more tubes with multiple rollers may smooth out the pulses of the peristaltic pump for a more continuous flow. The tubes 122, 124 may be positioned with respect to the case 102 by retainers 128. For example, the retainers 128 may retain each tube 122, 124 within a respective slot of the case 102.

Figure 4:
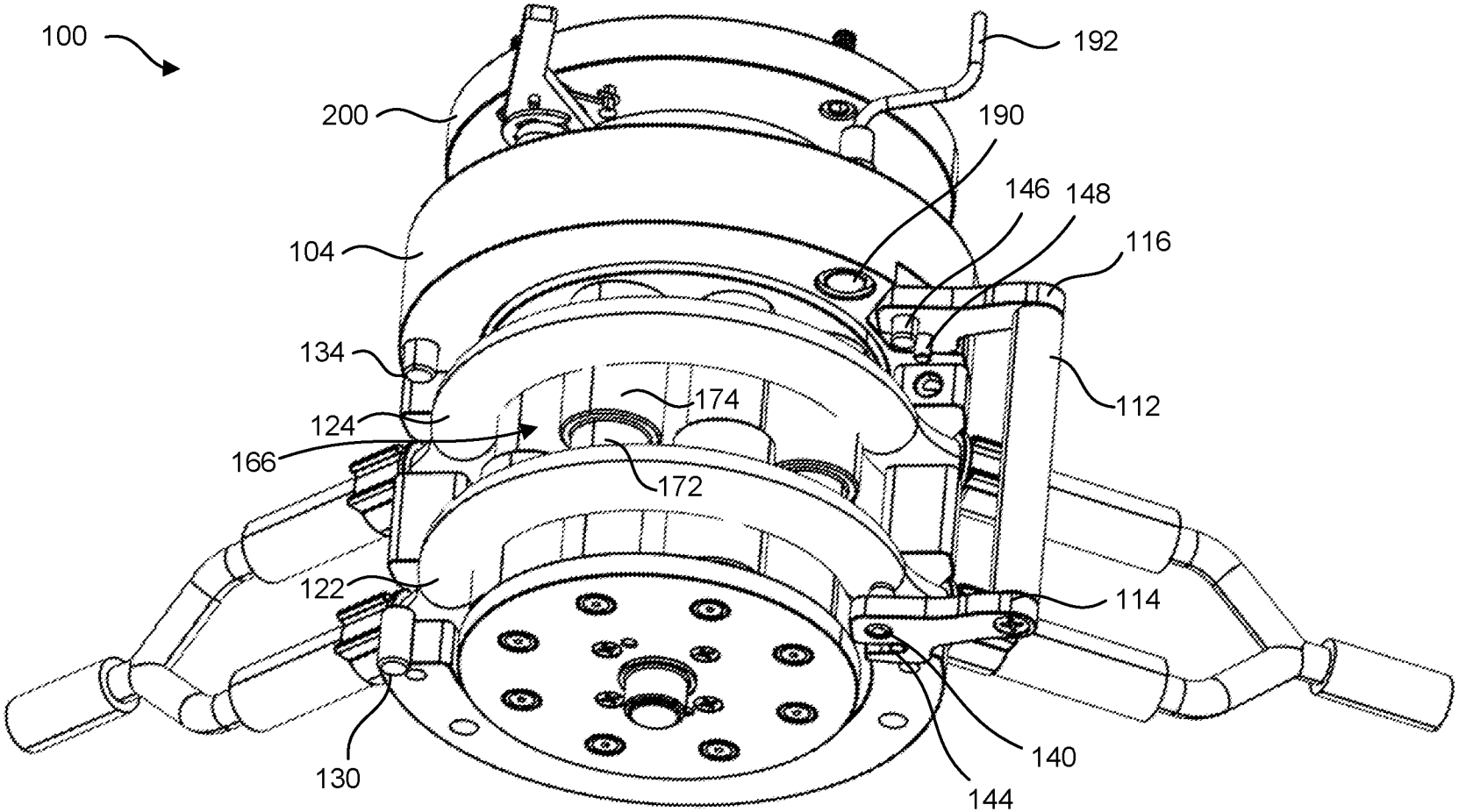
FIG. 4 is a top perspective view of the example peristaltic pump head of FIG. 1 with the arcuate occlusion bed removed, according to an aspect of the disclosure.

The arcuate occlusion bed 110 may be removable from the case 102, base 104, and end cap 106. Tubes 122 and 124 may be inserted into the pump head 100 with the arcuate occlusion bed 110 removed. The arcuate occlusion bed 110 may be mounted to the case 102, the base 104, and the end cap 106 on pins 130, 134 (FIG. 4). The arcuate occlusion bed 110 may be pressed against the tubes 122, 124 and locked onto the case 102 by a locking handle 112. The locking handle 112 may be a bar extending between cam members 114 and 116 that engage pins 144, 148 (FIG. 4).

Figure 2:
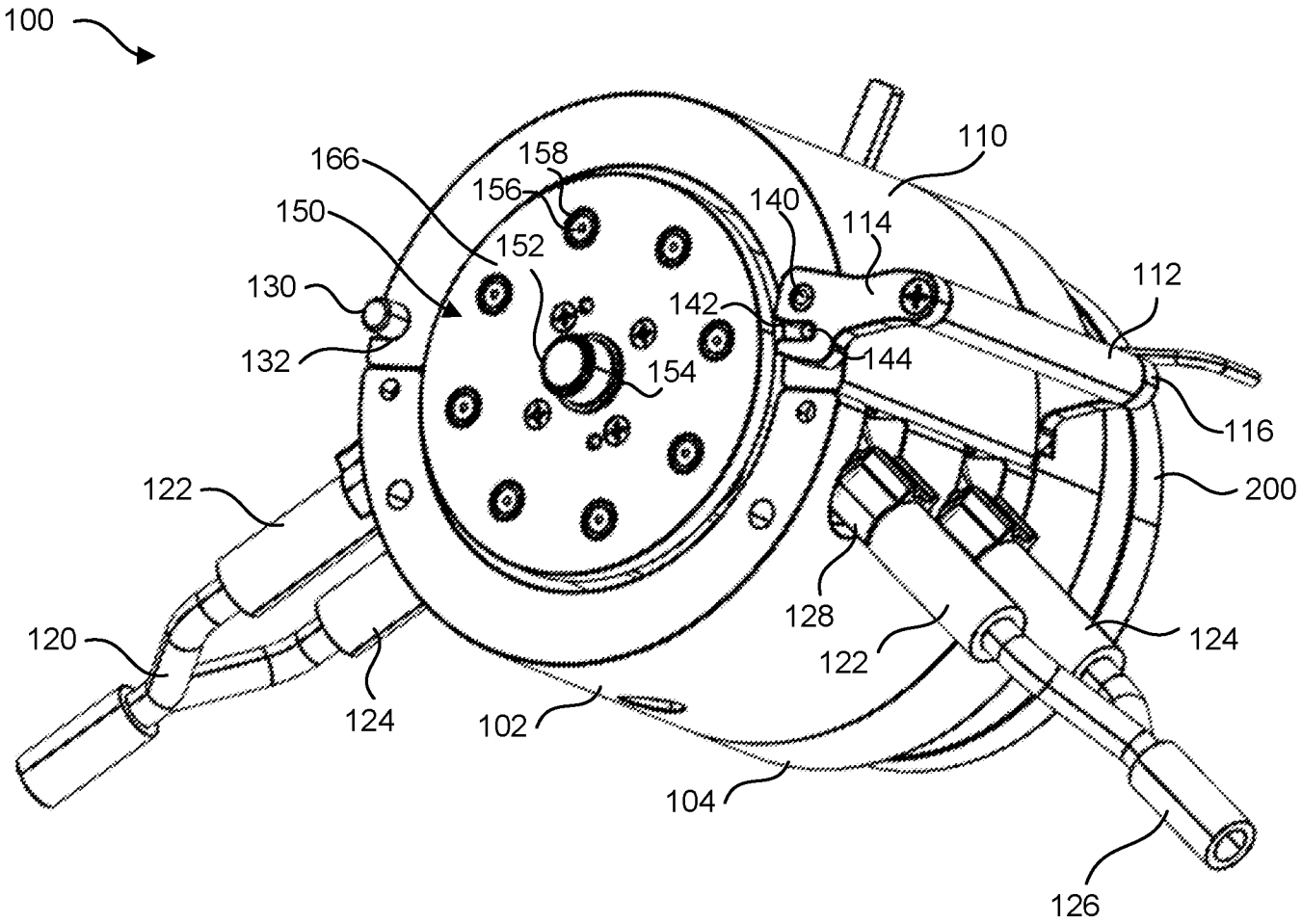
FIG. 2 is another perspective view of the example peristaltic pump head of FIG. 1 with an end cap removed, according to an aspect of the disclosure.
Figure 5:
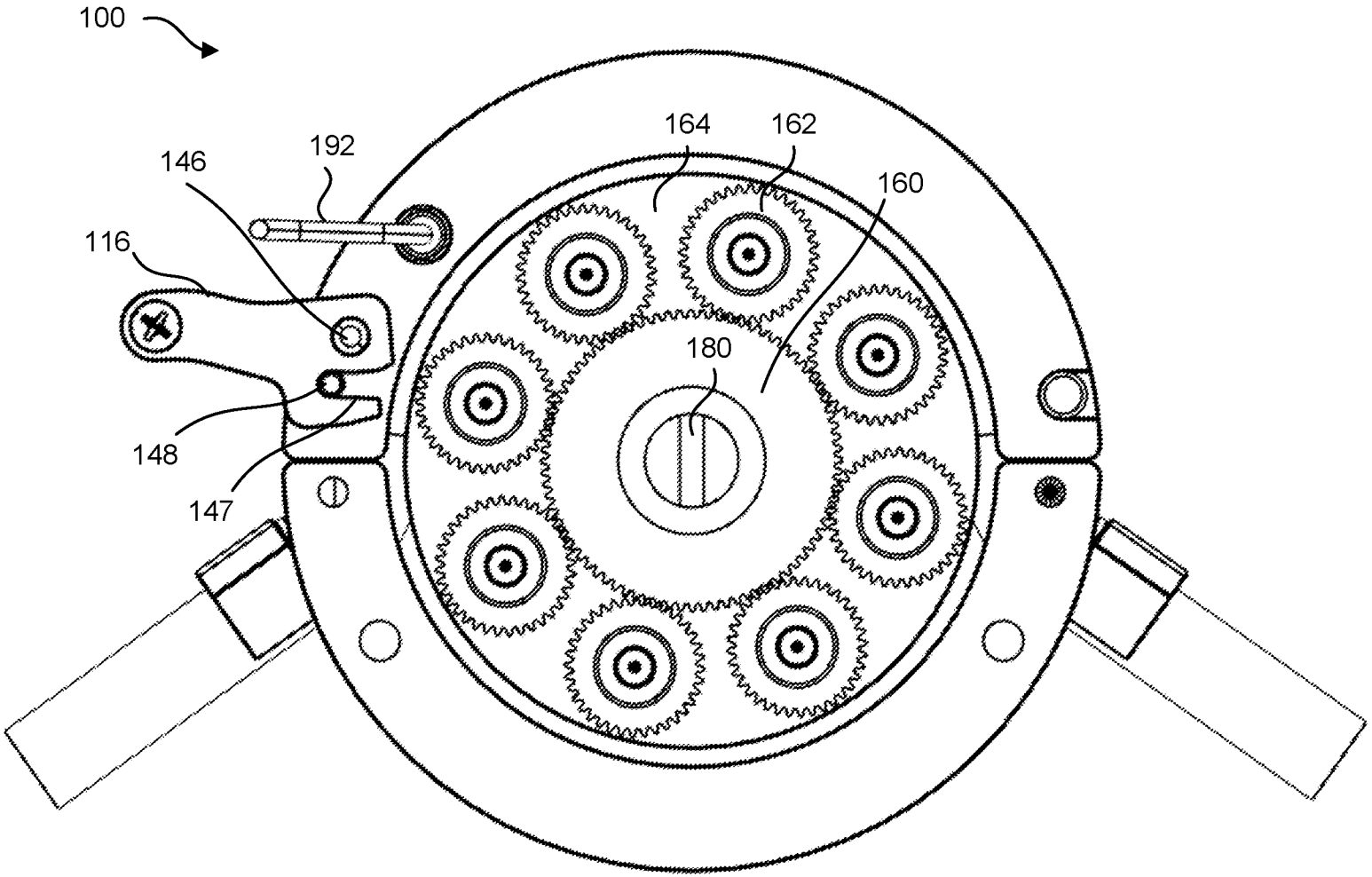
FIG. 5 is a back view of the example peristaltic pump head of FIG. 1 with a base removed, according to an aspect of the disclosure.

FIG. 2 is another perspective view of the example peristaltic pump head of FIG. 1 with the end cap 106 removed. The pin 130 extends from the end cap 106. The arcuate occlusion bed 110 includes a notch 132 that engages the pin 130. The arcuate occlusion bed 110 includes a similar notch on the opposite side that engages the pin 134. Accordingly, the arcuate occlusion bed 110 may pivot about the pins 130, 134. The cam members 114 and 116 may be pivotably mounted to the arcuate occlusion bed 110 via pins 140, 146 (FIG. 4). The cam members 114 and 116 may include a cam slot 142, 147 (FIG. 5). The cam slots 142, 147 may open at an end opposite the handle 112 and extend into the cam members 114, 116 in an arc centered at the pins 140, 146. As the handle 112 is pressed down (toward the case 102), the pins 144, 148 may enter the slots 142, 147 and slide along the arc surface to an internal end of the slot. The pressure of the arc surface against the pins 144, 148 may pivot the occlusion bed 110 toward the case 102, compressing the tubes 122, 124.

A rotor 150 is located within the case 102. The rotor 150 may include a base plate 164 (FIG. 5), an end plate 166, a central shaft 152, and a plurality of planetary shafts 156. The central shaft 152 may extend from outside the base 104 to the end cap 106, passing through the base plate 164 and the end plate 166. Each of the plurality of planetary shafts 156 may extend from the base plate 164 to the end plate 166.

In an aspect, the base plate 164 and the end plate 166 may include composite bushings 154 to allow the central shaft 152 to rotate within the base plate 164 and end plate 166. The base plate 164 and the end plate 166 may include composite bushings 158 to retain each of the planetary shafts 156 and allow rotation of the planetary shafts 156. In an aspect, the composite bushings 154 and composite bushings 158 may be a composite material such as a fiber reinforced polymer (FRP). For example, the composite bearings may include continuously wound polytetrafluoroethylene (PTFE) and high strength fibers encapsulated in an internally lubricated, high-temperature filled epoxy resin or a fiberglass encapsulated in a high-temperature epoxy resin. In an aspect, the composite bushings may provide a higher pressure-velocity (PV) rating than conventional bearings and produce less noise. The composite bushings may tolerate cleaning and sterilization processes that may utilize chemicals and high temperatures. The composite bushings may be replaceable.

Figure 3:
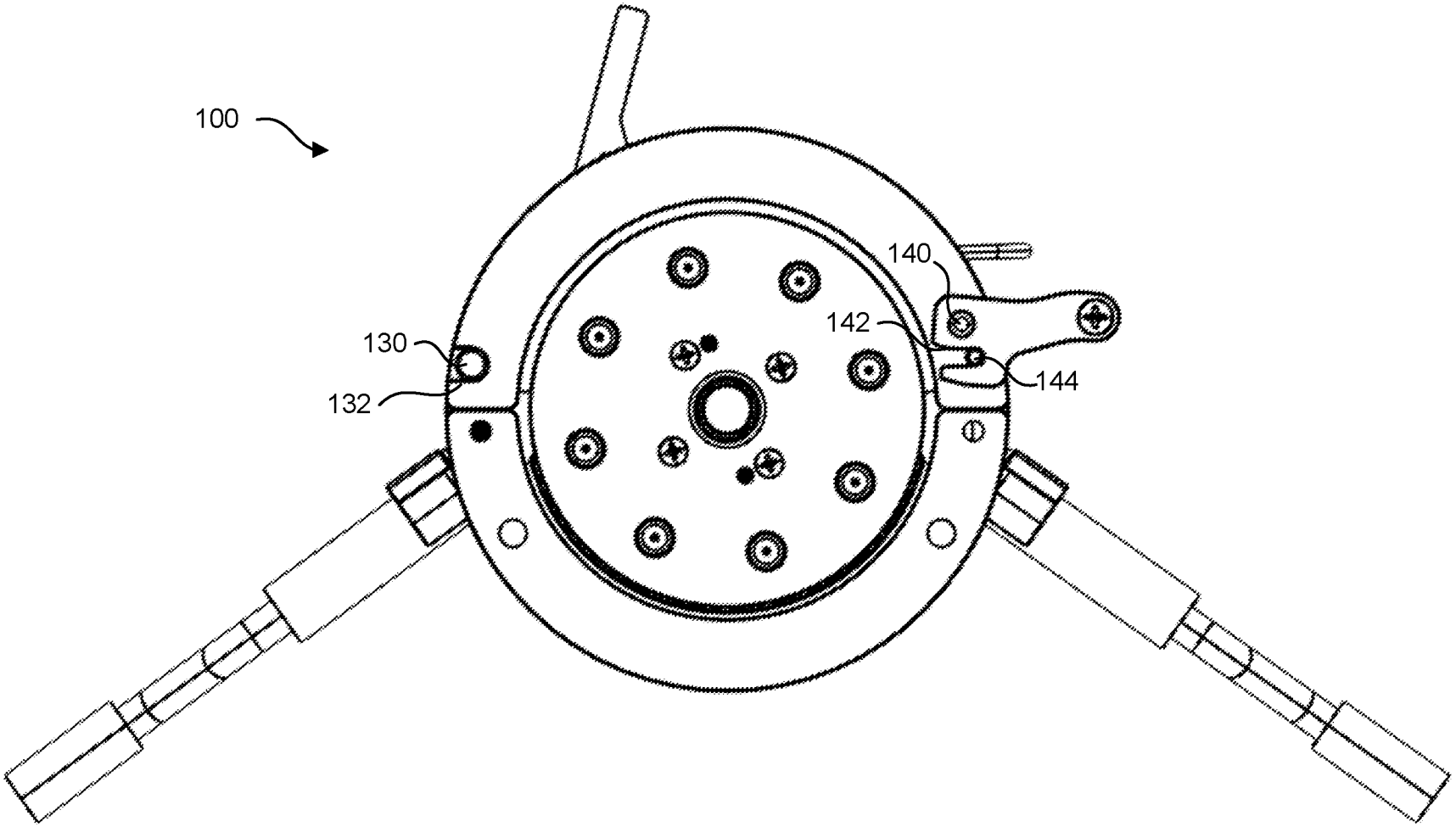
FIG. 3 is a front view of the example peristaltic pump head of FIG. 1, according to an aspect of the disclosure.

FIG. 3 is a front view of the example peristaltic pump head 100 of FIG. 1. The end cap 106 is not shown. The shape of the notch 132 and the cam slot 142 are shown.

FIG. 4 is a top perspective view of the example peristaltic pump head of FIG. 1 with the arcuate occlusion bed 110 removed. The tubes 122, 124 pass over rollers 170. Each roller 170 may include a narrow portion 172 having a first diameter and a wide portion 174 having a second diameter. The second diameter may be greater than the first diameter. The wide portion 174 may compress the tube 122, 124 as the roller squeezes the tube 122, 124 against the occlusion bed 110. The narrow portion 172 may not compress the tube 122, 124. The rollers 170 may alternate orientations around the central shaft 152 such that the tubes 122, 124 alternatingly pass over a narrow portion 172 and a wide portion 174. Accordingly, one tube 122 may be compressed while the other tube 124 is not compressed. This alternating compression may smooth out the pulses of the pump for a more constant flow rate.

The peristaltic pump head 100 may include an open head sensor 190. The open head sensor 190 may include a switch (e.g., a button) that opens when the arcuate occlusion bed 110 is attached to the arcuate case 102. For example, as illustrated, the open head sensor 190 may be located on the base 104 such that the arcuate occlusion bed 110 compresses the switch. The open head sensor 190 may be connected to a pump 300 (FIG. 6) via a wire 192. The pump 300 may stop rotation of the rotor 140 in response to the open head sensor 190 indicating that the arcuate occlusion bed 110 is not attached to the arcuate case 102.

FIG. 5 is a back view of the example peristaltic pump head of FIG. 1 with the base 104 removed. An adaptor 180 may be attached to the end of the central shaft 152. The adaptor 180 may include a rectangular end or other shape corresponding to a pump drive. A central gear 160 may be connected to the central shaft 152. A respective planetary gear 162 may be connected to each of the planetary shafts 156. As discussed above, the planetary shafts 156 may be retained in the base plate 164 within composite bushings. The central gear 160 may mesh with each of the planetary gears 162. Accordingly, rotation of the central shaft 152 via the adaptor 180 may rotate the central gear 160, which in turn rotates each of the planetary gears 162, the planetary shafts 156, and the rollers 170.

The cam member 116 is visible in FIG. 5. Similar to the cam member 114, the cam member 116 is pivotably mounted on a pin 146. The cam member 116 includes a slot 147 that engages a pin 148. The cam slot 147 is arc shaped about the pin 146. The cam member 116 is aligned with the cam member 114 such that pressure on the handle 112 simultaneously pivots both the cam member 114 and 116 to receive the respective pins 144, 148. Accordingly, over the center pressure on the handle 112 closes the occlusion bed 110 without twisting.

Figure 6:
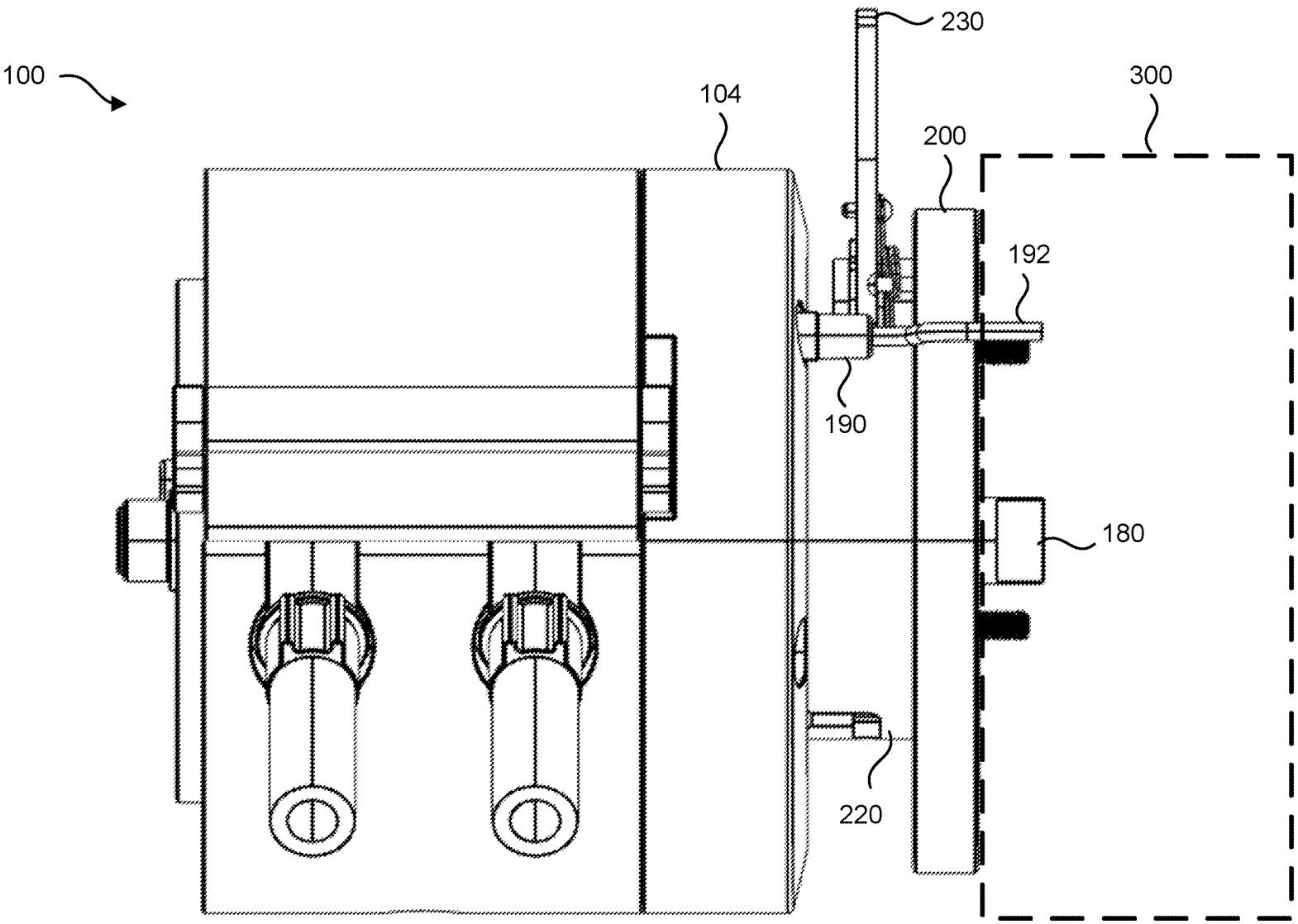
FIG. 6 is a side view of the example peristaltic pump head of FIG. 1 mounted to a pump, according to an aspect of the disclosure.

FIG. 6 is a side view of the example peristaltic pump head 100 of FIG. 1 mounted to a pump 300 via a connector 200. The pump 300 may include a motor and control circuitry (not shown) for rotating the central shaft 152 via the adaptor 180. The connector 200 may be attached to the pump 300 via fasteners such as screws or bolts. The connector 200 may include an annular collar 220 that receives a mounting hub of the pump head 100.

Figure 7:
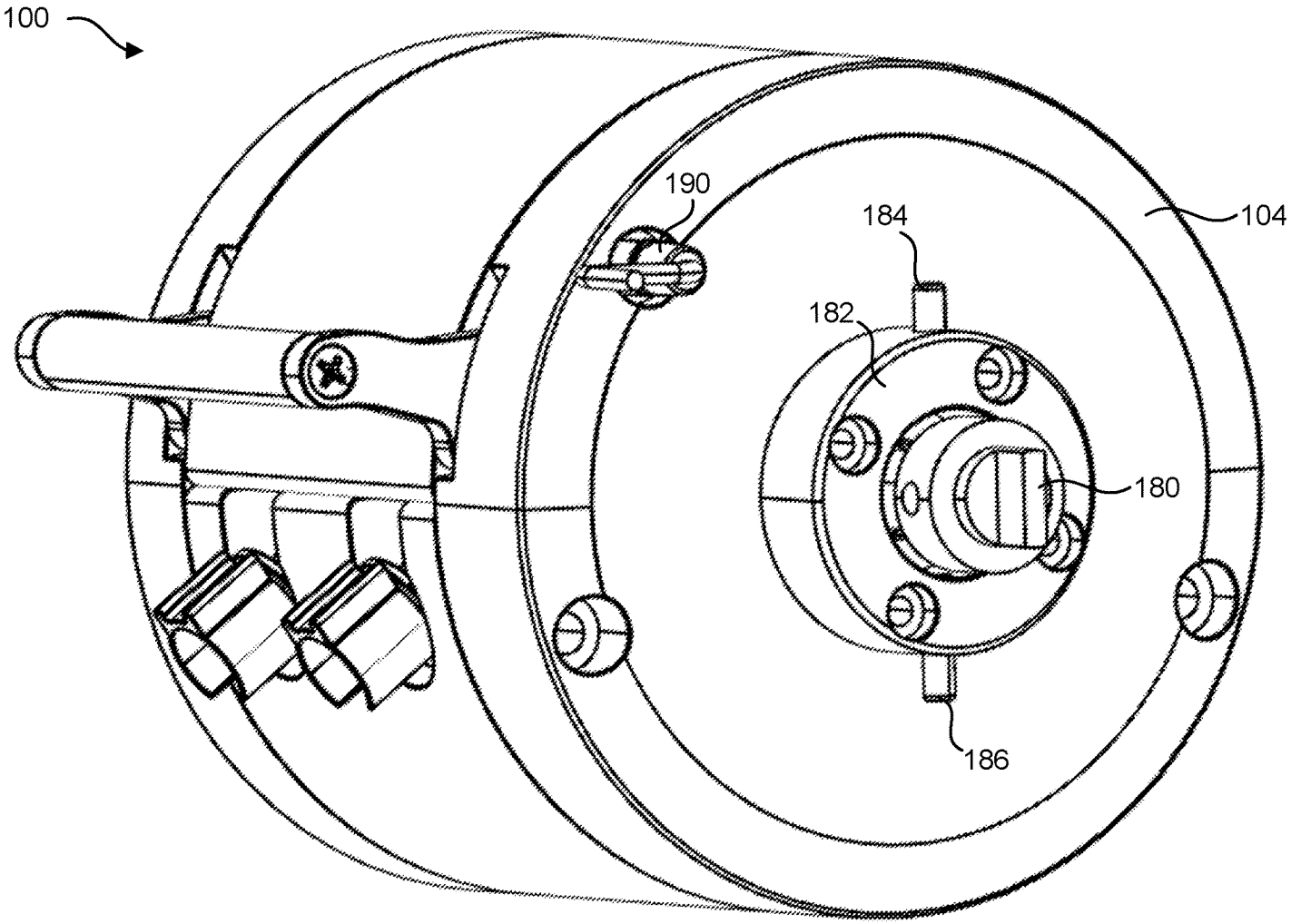
FIG. 7 is a rear perspective view of the example peristaltic pump head of FIG. 1, according to an aspect of the disclosure.

FIG. 7 is a rear perspective view of the example peristaltic pump head of FIG. 1 showing the mounting hub 182. The mounting hub 182 may be attached to the base 104 via fasteners such as screws or bolts. The mounting hub 182 may have a cylindrical shape with a diameter slightly less than an internal diameter of the annular collar 220. The mounting hub 182 may include posts 184, 186 that extend radially from opposite sides of the mounting hub 182.

Figure 8:
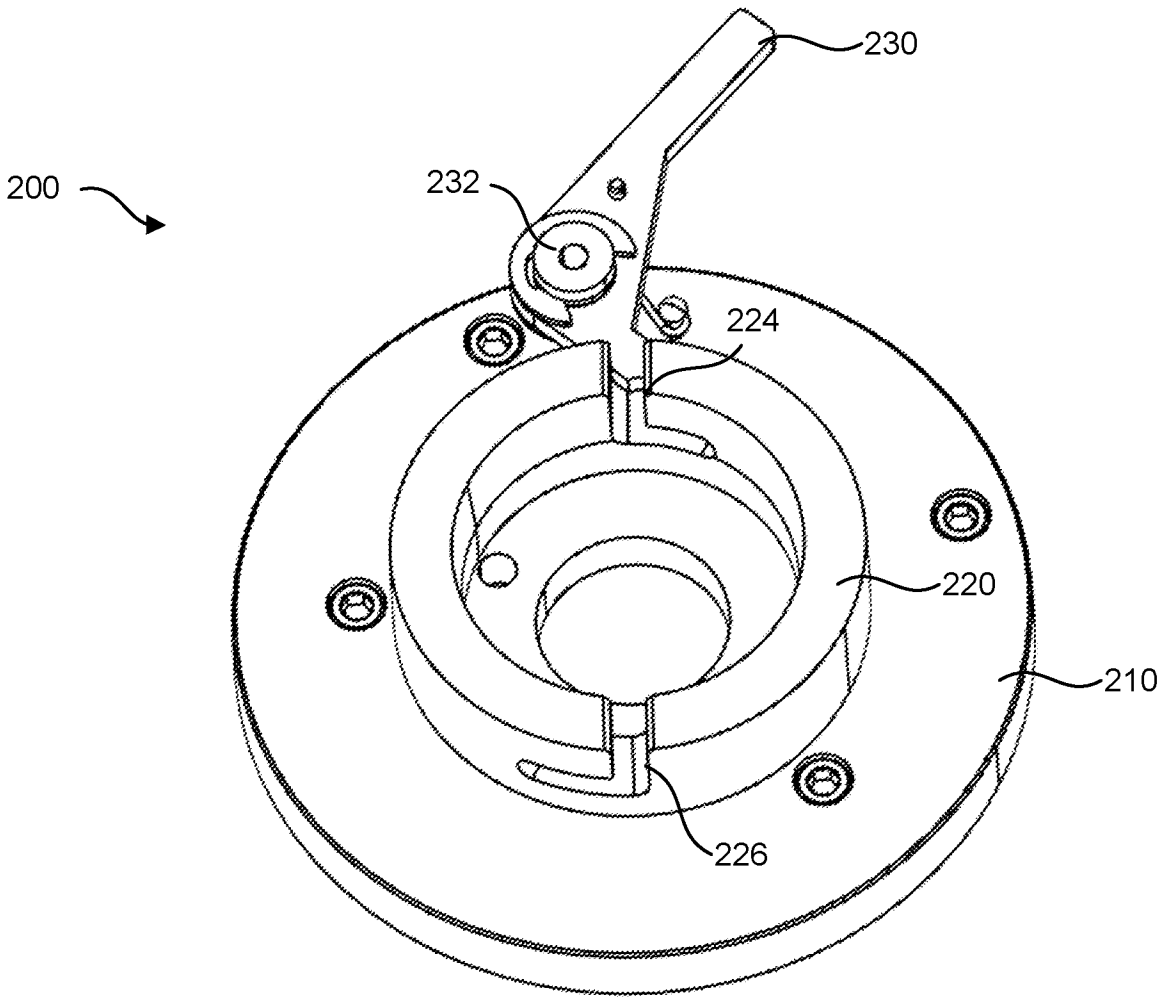
FIG. 8 is a perspective view of an example connector including a mounting plate and annular collar, according to an aspect of the disclosure.

FIG. 8 is a perspective view of an example connector 200 including a mounting plate 210 and annular collar 220. The mounting plate 210 may be a disc with a central opening to allow the central shaft 152 to pass into the pump 300. The mounting plate 210 may include openings that correspond to mounting holes in the pump 300. The annular collar 220 may be attached to the mounting plate 210 via fasteners from a back side of the mounting plate 210. The mounting plate 210 may be selected with openings corresponding to a particular model of pump 300. The annular collar 220 may include L-shaped slots 224, 226. Each of the L-shaped slots 224, 226 may have an opening at an exterior surface of the annular collar 220 and turn at a right angle to extend circumferentially within the annular collar 220. The L-shaped slots 224, 226 may receive the posts 184, 186. A lock lever 230 may be pivotably mounted to the mounting plate 210 and aligned with one of the L-shaped slots 224. A biasing element 232 such as a spring may bias the lock lever 230 into the L-shaped slot 224.

Figure 9:
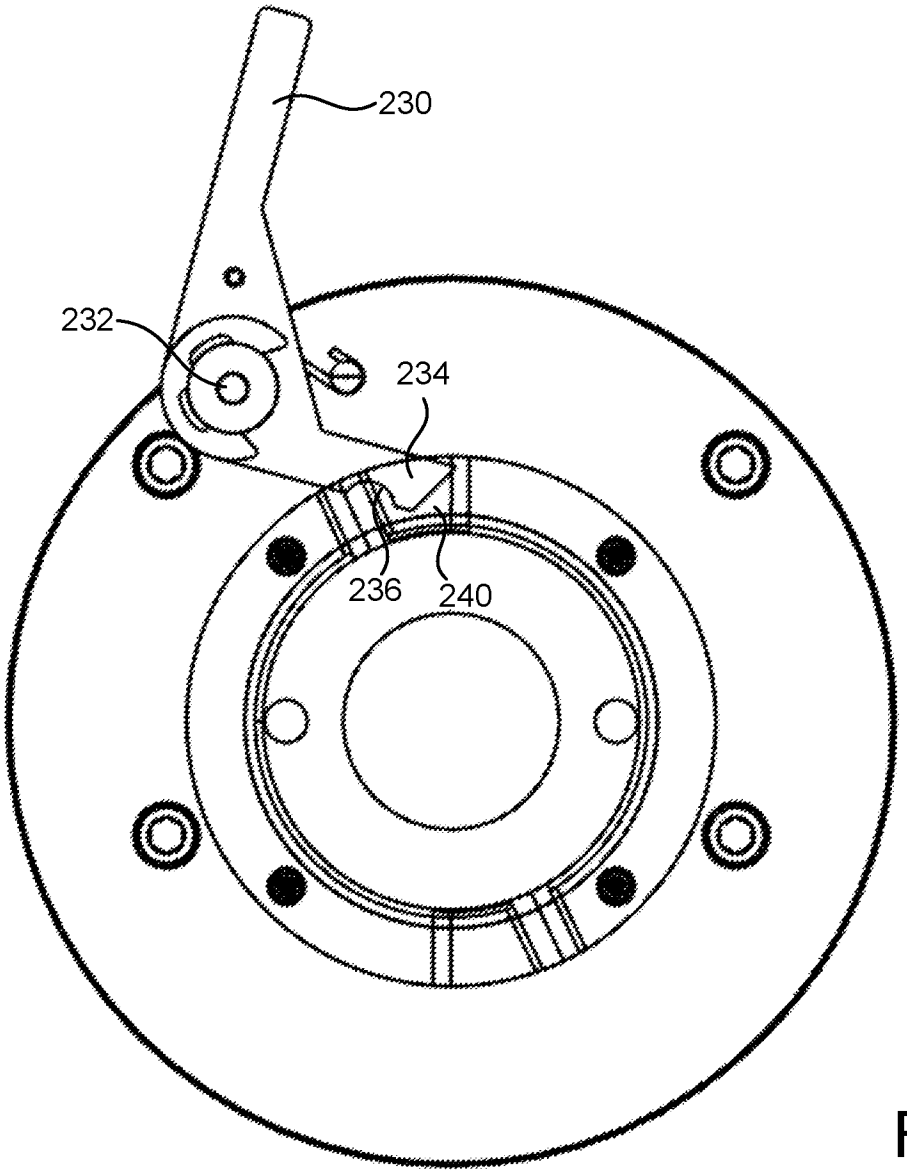
FIG. 9 is a plan view of the example connector of FIG. 8 with a transparent annular collar, according to an aspect of the disclosure.

FIG. 9 is a plan view of the example connector 200 of FIG. 9 with the annular collar 220 shown as transparent. The lock lever 230 may have a locking end 234 that is biased into the L-shaped slot 224. A curved surface 236 may face the interior of the annular collar 220. When one of the posts 184, 186 is inserted into the L-shaped slot 224 and rotated, the posts 184, 186 may push against curved surface 236, overcome the biasing force, and travel to an end 240 of the L-shaped slot 224. Once the post 184, 186 clears the locking end 234, the locking end 234 may enter the L-shaped slot 224 behind the post 184, 186, locking the post 184, 186 at the end 240 of the L-shaped slot. The lock lever 230 may be rotated against the biasing force to release the post 184, 186 and the pump head 100.

Figure 10:
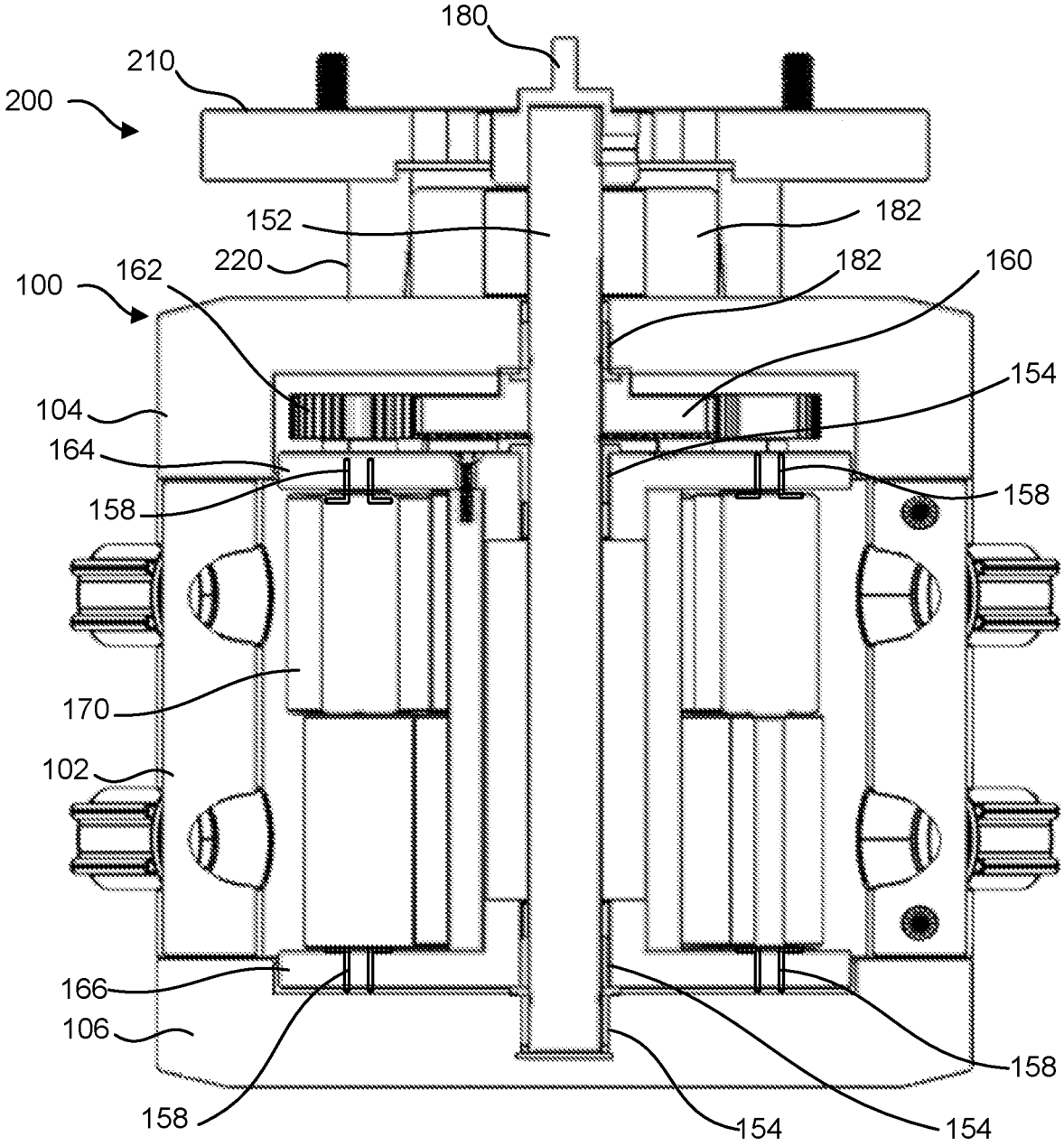
FIG. 10 is a cross-sectional view of the example peristaltic pump head of FIG. 1, according to an aspect of the disclosure.

FIG. 10 is a cross-sectional view of the example peristaltic pump head 100 of FIG. 1. As discussed above, composite bushings 154 may be located in the base 104, base plate 164, end plate 166, and end cap 106 to allow the central shaft 152 to rotate. Composite bushings 158 may be located in the base plate 164 and the end plate 166 to allow the planetary shafts 156 and rollers 170 to rotate.

This written description uses examples to disclose aspects of the invention, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

The invention claimed is:

1. A peristaltic pump head, comprising:

a rotor rotatably mounted between a base of the peristaltic pump head and an end cap of the peristaltic pump head, wherein the rotor comprises:

a base plate;

an end plate;

a central shaft extending through the base plate and the end plate;

a central gear driven by the central shaft; and a plurality of planetary shafts mounted between the base plate and the end plate around the central shaft, each planetary shaft connected to a planetary gear in meshed engagement with the central gear;

a pair of composite bushings in each of the base and the end cap rotatably retaining the central shaft;

a pair of composite bushings in the base plate and the end plate retaining each of the plurality of planetary shafts;

a case between the base and the end cap partially surrounding the rotor;

an occlusion bed removably mounted between the base and the end cap, wherein the case and the occlusion bed form a body around the rotor; and a locking handle hingedly mounted to the occlusion bed, wherein the locking handle includes a bar extending between first and second cam members, each cam member including a cam slot;

wherein a first pin is attached to and extends axially away from an outward facing side of the base in a direction toward an inward side of the occlusion bed and at right angles to the first cam members and its cam slot, and wherein a second pin is attached to and extends axially away from an inward facing side of the end cap in a direction toward an outward side of the occlusion bed and at right angles to the second cam member and its cam slot;

wherein a third pin is attached to and extends axially away from the outward facing side of the base, the third pin being spaced arcuately apart from the first pin, and wherein a fourth pin is attached to and extends axially away from the inward facing side of the end cap, the fourth pin being spaced arcuately apart from the second pin;

wherein the occlusion bed includes a first notch on an end of the occlusion bed that is opposite from where the first and second cam members are mounted, and the occlusion bed includes a second notch on the same end of the occlusion bed but on an opposite side; and wherein the occlusion bed is mounted and locked to the base and the end cap when the first and second notches are engaged to the third and fourth pins and the cam slots of the first and second cam members are engaged to the first and second pins.

2. A peristaltic pump, comprising:

a pump head, comprising:

a rotor rotatably mounted between a base of the peristaltic pump head and an end cap of the peristaltic pump head, the rotor having a central shaft extending through the base;

an arcuate case between the base and the end cap partially surrounding the rotor;

an arcuate occlusion bed removably mounted between the base and the end cap, wherein the arcuate case and the arcuate occlusion bed form a cylindrical body around the rotor; and a locking handle hingedly mounted to the arcuate occlusion bed, wherein the locking handle includes a bar extending between a pair of cam members, each cam member including a cam slot that engages a respective pin extending from the base and the end cap;

wherein a first pin is attached to and extends axially away from an outward facing side of the base in a direction toward an inward side of the occlusion bed and at right angles to the first cam members and its cam slot, and wherein a second pin is attached to and extends axially away from an inward facing side of the end cap in a direction toward an outward side of the occlusion bed and at right angles to the second cam member and its cam slot;

wherein a third pin is attached to and extends axially away from the outward facing side of the base, the third pin being spaced arcuately apart from the first pin, and wherein a fourth pin is attached to and extends axially away from the inward facing side of the end cap, the fourth pin being spaced arcuately apart from the second pin;

wherein the occlusion bed includes a first notch on an end of the occlusion bed that is opposite from where the first and second cam members are mounted, and the occlusion bed includes a second notch on the same end of the occlusion bed but on an opposite side; and wherein the occlusion bed is mounted and locked to the base and the end cap when the first and second notches are engaged to the third and fourth pins and the cam slots of the first and second cam members are engaged to the first and second pins;

a mounting plate attached to an external surface of a housing, the mounting plate having an internal wall defining an opening into the housing for receiving an end of the central shaft of the pump head;

an annular collar extending from an external surface of the mounting plate on an opposite side of the mounting plate that is attached to the housing, the annular collar surrounding the opening, the annular collar including a pair of L-shaped slots with an opening at an exterior surface of the annular collar;

a lock lever pivotably mounted to the mounting plate and movable between a locked position with an end of the lock lever within one of the L-shaped slots and an unlocked position with the end of the lock lever outside of the L-shaped slot; and a cylindrical mounting hub mounted to an external surface of the base on a side of the base that is opposite from the rotor, the mounting hub configured to be received within the annular collar, wherein the mounting hub includes a pair of radially extending posts that engage the L-shaped slots.

3. The peristaltic pump of claim 2, wherein the end of the lock lever is located between an end of the L-shaped slot and the opening of the L-shaped slot in the locked position and retains one of the radially extending posts near the end of the L-shaped slot.

4. The peristaltic pump of claim 2, further comprising an open head sensor located in the pump head and configured to detect presence of the arcuate occlusion bed, wherein the peristaltic pump is configured to stop rotation of the rotor in response to the open head sensor indicating that the arcuate occlusion bed is not present.

5. The peristaltic pump of claim 2, wherein the rotor comprises:

a base plate;

an end plate;

the central shaft extending through the base plate and the end plate;

a central gear driven by the central shaft; and a plurality of planetary shafts mounted between the base plate and the end plate around the central shaft, each planetary shaft connected to a planetary gear in meshed engagement with the central gear;

wherein the pump head includes a pair of composite bushings in each of the base and the end cap, the bushings rotatably retaining the central shaft; and a pair of composite bushings in the base plate and the end plate retaining each of the plurality of planetary shafts.

* * * * *